US012084224B2

(12) United States Patent
Leng

(10) Patent No.: US 12,084,224 B2
(45) Date of Patent: Sep. 10, 2024

(54) SPLICED STORAGE BOX AND A SPLICING STRUCTURE BETWEEN ADJACENT SIDE PANELS THEREOF

(71) Applicant: New-Tec Integration (Xiamen) Co., Ltd., Xiamen (CN)

(72) Inventor: Luhao Leng, Xiamen (CN)

(73) Assignee: NEW-TEC INTEGRATION (XIAMEN) CO., LTD., Fujian (CN)

( * ) Notice: Subject to any disclaimer, the term of this patent is extended or adjusted under 35 U.S.C. 154(b) by 423 days.

(21) Appl. No.: 17/465,198

(22) Filed: Sep. 2, 2021

(65) Prior Publication Data

US 2021/0394955 A1 Dec. 23, 2021

Related U.S. Application Data

(63) Continuation of application No. PCT/CN2020/096361, filed on Jun. 16, 2020.

(30) Foreign Application Priority Data

Jun. 19, 2019 (CN) ..... 201910532048.X

(51) Int. Cl.
*B65D 6/24* (2006.01)
*B65D 5/00* (2006.01)

(52) U.S. Cl.
CPC ..... *B65D 11/1873* (2013.01); *B65D 5/006* (2013.01)

(58) Field of Classification Search
CPC ..... B65D 11/1873; B65D 5/006; B65D 2519/00641; B65D 5/4283; B65D 5/445;
(Continued)

(56) References Cited

U.S. PATENT DOCUMENTS 3,226,008 A 12/1965 Chiorri
4,078,716 A * 3/1978 Harley ..... B65D 5/006 24/336

(Continued)

FOREIGN PATENT DOCUMENTS

CN 201104371 Y 8/2008
CN 102960978 A 3/2013

(Continued)

OTHER PUBLICATIONS

International Search Report and English translation as cited in PCT/CN2020/096361 mailed on Sep. 27, 2020, 8 pages.

(Continued)

*Primary Examiner* — Christopher R Demeree
(74) *Attorney, Agent, or Firm* — Cooper Legal Group, LLC

(57) ABSTRACT

A spliced storage box and a splicing structure between adjacent side panels of the spliced storage box are provided. The splicing structure comprises two side panels, a post, and a pressing strip. A side of the post comprises a notch, each corner of two sides of the notch comprises a first positioning edge and a second positioning edge intersecting the first positioning edge. Side edges, which are adjacent to each other, of the two side panels each bend and define a first abutting edge and a second abutting edge. The first abutting edge is disposed at an outer end of a respective one of the two side panels, and the first abutting edge and the second abutting edge respectively abut the first positioning edge and the second positioning edge. The pressing strip is connected to the post and is pressed to the first abutting edges of the two side panels.

26 Claims, 14 Drawing Sheets

(58) Field of Classification Search
CPC ..... B65D 7/12; B65D 88/528; B65D 9/24; B65D 2519/00273; B65D 81/053; B65D 9/34; A47B 87/0215; A47B 87/0284; A47B 47/0083
USPC .... 229/198.1, 918, 199, 919; 220/4.33, 684, 220/4.28, 652, 642; 217/69; 206/453, 206/586
See application file for complete search history.

(56) References Cited

U.S. PATENT DOCUMENTS 4,210,274 A * 7/1980 Leonard ..... B65D 5/445 229/918
5,538,178 A * 7/1996 Zink ..... B65D 19/06 493/115
5,813,556 A 9/1998 Onken
6,915,603 B2 * 7/2005 Hunt ..... B65D 9/24 206/386

FOREIGN PATENT DOCUMENTS

| | | | |
|---|---|---|---|
| CN | 108216831 | A | 6/2018 |
| CN | 110065735 | A | 7/2019 |
| CN | 110406770 | A | 11/2019 |
| CN | 210708395 | U | 6/2020 |
| EP | 3369679 | A1 | 9/2018 |
| FR | 1271481 | A | 9/1961 |

OTHER PUBLICATIONS

Written Opinion as cited in PCT/CN2020/096361 mailed on Sep. 27, 2020, 4 pages.

* cited by examiner

SPLICED STORAGE BOX AND A SPLICING STRUCTURE BETWEEN ADJACENT SIDE PANELS THEREOF

RELATED APPLICATIONS

This application claims priority to PCT patent application number PCT/CN2020/096361, filed Jun. 16, 2020, which claims priority to Chinese patent application number 201910532048.X, filed on Jun. 19, 2019. PCT patent application number PCT/CN2020/096361 and Chinese patent application number 201910532048.X are incorporated herein by reference.

FIELD OF THE DISCLOSURE

The present disclosure relates to a spliced storage box and a splicing structure between adjacent side panels thereof, and in particular to a plastic spliced storage box and a splicing structure between adjacent side panels thereof.

BACKGROUND OF THE DISCLOSURE

In spliced storage boxes, such as made of wood, side panels are connected through a tenon joint structure. Some of the side panels may be connected through a hinge structure. However, the hinge structure is more often used on metal boxes. The spliced storage boxes are rarely made of plastic materials due to the side panels made of the plastic materials having a poor strength due to not being firmly spliced to each other. Therefore, spliced storage boxes made of plastic materials are all formed by integrally molding.

Applicant has previously developed a spliced storage box made of plastic material. Strength-improvement members are embedded inside of all sides of the side panels to increase the strength of the spliced storage box, and strength-improvement members respectively disposed on adjacent side panels are connected to each other through pins and slots. However, the side panels easily sway relative to each other, and there are also large gaps between the side panels. The degree of simplicity is not high, and rain and cockroaches easy enter the spliced storage boxes.

BRIEF SUMMARY OF THE DISCLOSURE

The present disclosure provides a spliced storage box and a splicing structure between adjacent side panels thereof to eliminate the gap between the side panels, so that the connection between the side panels is simple and firm.

A first technical solution of the present disclosure is as follows.

A splicing structure between adjacent side panels of a spliced storage box comprises two side panels adjacent to each other, a post disposed vertically, and a pressing strip disposed vertically. A side of the post comprises a notch, each corner of two sides of the notch comprises a first positioning edge and a second positioning edge intersecting the first positioning edge, and the first positioning edge is disposed in the notch. Side edges, which are adjacent to each other, of the two side panels each bend and define a first abutting edge and a second abutting edge, which correspond to a shape of each corner of the two sides of the notch, and the first abutting edge is disposed at an outer end of a respective one of the two side panels. The first abutting edge and the second abutting edge respectively abut the first positioning edge and the second positioning edge. The pressing strip is disposed in the notch and is connected to the post. The pressing strip is pressed to the first abutting edges of the two side panels.

A second technical solution of the present disclosure is as follows.

A spliced storage box comprises an opening and closing door, a plurality of side panels, a plurality of posts, and a pressing strip. The opening and closing door is disposed on a front end surface of the spliced storage box. At least two of the plurality of side panels disposed on a left side and a right side of the spliced storage box are respectively connected to at least one of the plurality of side panels disposed on a rear side of the spliced storage box through a respective one of the plurality of posts. A side of each of the plurality of posts comprises a notch, each corner of two sides of the notch comprises a first positioning edge and a second positioning edge intersecting the first positioning edge, and the first positioning edge is disposed in the notch. Side edges, which are adjacent to each other, of two of the plurality of side panels disposed on two sides of each of the plurality of posts each bend and define a first abutting edge and a second abutting edge, which correspond to a shape of each corner of the two sides of the notch. The first abutting edge is disposed at an outer end of each of the two of the plurality of side panels disposed on the two sides of each of the plurality of posts. The first abutting edge and the second abutting edge of each of the two of the plurality of side panels disposed on the two sides of each of the plurality of posts respectively abut the first positioning edge and the second positioning edge disposed on each of the two sides of the notch. The pressing strip is disposed vertically, and the pressing strip is disposed in the notch. The pressing strip is connected to each of the plurality of posts, and the pressing strip is pressed on the first abutting edges of the two of the plurality of side panels disposed on the two sides of each of the plurality of posts.

A third technical solution of the present disclosure is as follows.

A spliced storage box comprises an upper cover, a bottom panel, a connecting frame, a plurality of side panels, a plurality of posts, and a pressing strip. The connecting frame is disposed in a middle of the spliced storage box so that the spliced storage box is divided into an upper layer box and a lower layer box along the connecting frame. At least two of the plurality of side panels disposed on a left side and a right side of the upper layer box are respectively connected to at least one of the plurality of side panels disposed on a rear side of the upper layer box through a respective one of a first set of the plurality of posts. An upper end and a lower end of each of the first set of the plurality of posts disposed on the upper layer box are respectively connected to the upper cover and the connecting frame through an insertion manner. At least two of the plurality of side panels disposed on a left side and a right side of the lower layer box are respectively connected to at least one of the plurality of side panels disposed on a rear side of the lower layer box through a respective one of a second set of the plurality of posts. An upper end and a lower end of each of the second set of the plurality of posts disposed on the lower layer box are respectively connected to the connecting frame and the bottom panel through an insertion manner. A side of each of the plurality of posts comprises a notch, each corner of two sides of the notch comprises a first positioning edge and a second positioning edge intersecting the first positioning edge, and the first positioning edge is disposed in the notch. Side edges, which are adjacent to each other, of two of the plurality of side panels disposed on two sides of each of the plurality of posts each bend and define a first abutting edge and a second abutting edge, which correspond to a shape of each corner of the two sides of the notch. The first abutting edge is disposed at an outer end of each of the two of the plurality of side panels disposed on the two sides of each of the plurality of posts. The first abutting edge and the second abutting edge of each of the two of the plurality of side panels disposed on the two sides of each of the plurality of posts respectively abut the first positioning edge and the second positioning edge disposed on each of the two sides of the notch. The pressing strip is disposed vertically, the pressing strip is disposed in the notch, the pressing strip is connected to each of the plurality of posts, and the pressing strip is pressed on the first abutting edges of the two of the plurality of side panels disposed on the two sides of each of the plurality of posts.

A fourth technical solution of the present disclosure is as follows.

A corner board comprises two side panels, a post, and a pressing strip. The post connects the two side panels. A side of the post comprises a notch. Each of two sides of the notch comprises a first positioning edge and a second positioning edge intersecting the first positioning edge, and the first positioning edge is disposed in the notch. Side edges, which are adjacent to each other, of the two side panels each bend and define a first abutting edge and a second abutting edge, which correspond to a shape of each corner of the two sides of the notch. The first abutting edge is disposed at an outer end of a respective one of the two side panels. The first abutting edge and the second abutting edge respectively abut the first positioning edge and the second positioning edge. The pressing strip is disposed vertically, the pressing strip is disposed in the notch, the pressing strip is connected to the post, and the pressing strip is pressed to the first abutting edges of the two side panels.

Compared with the existing techniques, the technical solution has the following advantages.

The two side panels are connected to each other through the post. The first abutting edge and the second abutting edge defined by the side panel are respectively matched with the first positioning edge and the second positioning edge defined by the corner of the notch, and the pressing strip is pressed on the first positioning edge so as to enable the side panel to be fixedly connected to the post. The pressing strip is disposed in the notch, which is tidy. The notch of the post extends between the two side panels to eliminate the gap between the side panels so that rain and cockroaches are prevented from entering the spliced storage box, and the strength of the spliced storage box is further improved.

DETAILED DESCRIPTION OF THE EMBODIMENTS

The present disclosure will be further described below in combination with the accompanying drawings and embodiments.

Figure 1:
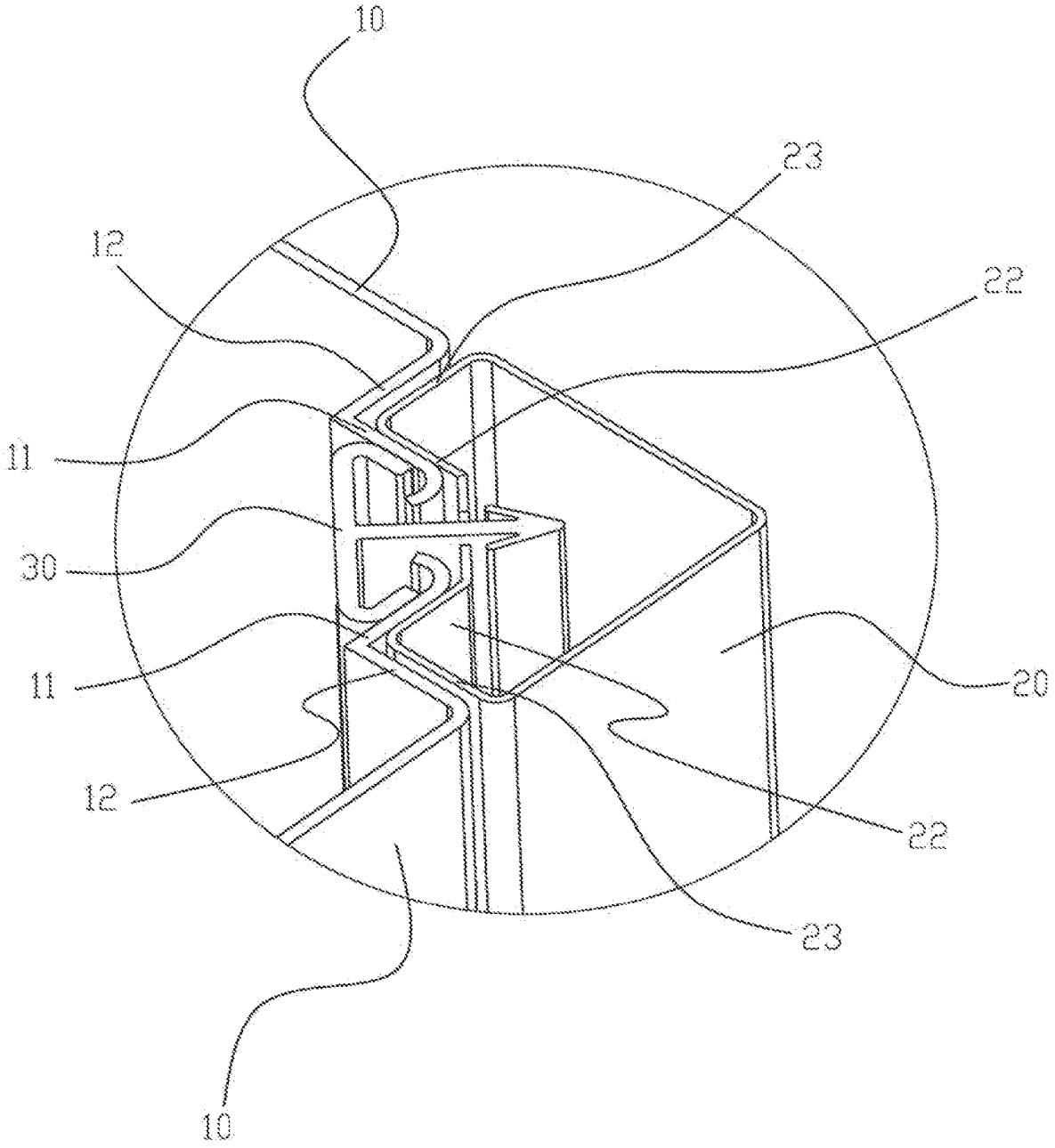
FIG. 1 illustrates a perspective view of a splicing structure between adjacent side panels in the present disclosure.
Figure 2:
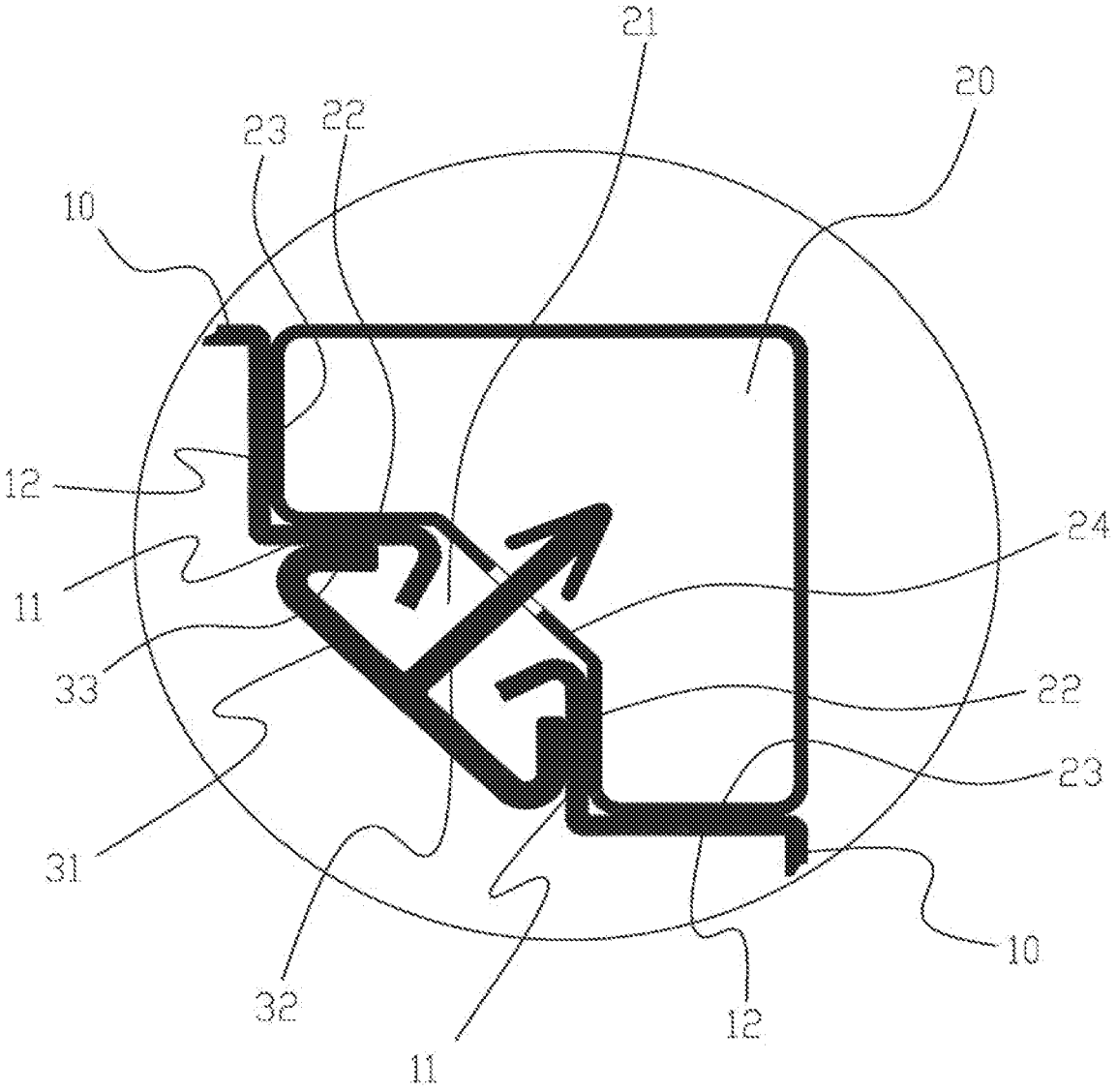
FIG. 2 illustrates a top view of the splicing structure between adjacent side panels shown in FIG. 1.

Referring to FIG. 1 and FIG. 2, a splicing structure between adjacent side panels of a spliced storage box comprises two side panels 10 and a post 20 connected between the two side panels 10. A side of the post 20 comprises a notch 21, and the notch 21 appears trapezoidal. Each corner of two sides of the notch 21 comprises a first positioning edge 22 and a second positioning edge 23 intersecting the first positioning edge 22, and the first positioning edge 22 is disposed in the notch 21. Side edges, which are adjacent to each other, of the two side panels 10 each bend and define a first abutting edge 11 and a second abutting edge 12, which correspond to a shape of each corner of the two sides of the notch 21. The first abutting edge 11 is disposed at an outer end of a respective one of the two side panels 10. The first abutting edge 11 and the second abutting edge 12 respectively abut the first positioning edge 22 and the second positioning edge 23. That is, the first abutting edge 11 is matched with the first positioning edge 22, and the second abutting edge 12 is matched with the second positioning edge 23. The splicing structure further comprises a pressing strip 30, and the pressing strip 30 is disposed in the notch 21 and is connected to the post 20. Two side edges of the pressing strip 30 are respectively pressed to the first abutting edges 11 of the two side panels 10. In a preferred embodiment, the two side panels 10 are blister boards, the post 20 is a plastic hollow column, and the pressing strip 30 is a plastic pressing strip.

Figure 4:
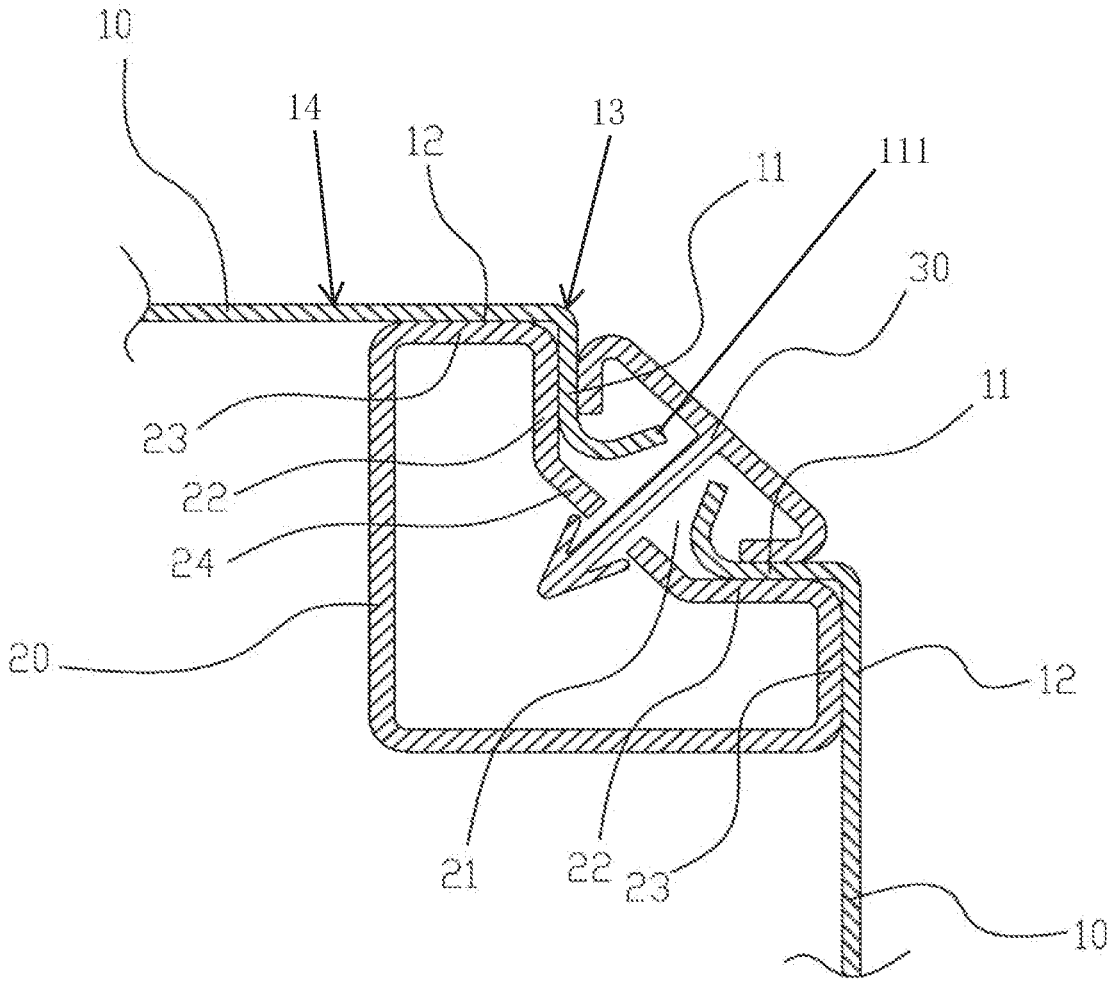
FIG. 4 illustrates a top view of a second type of splicing structure between adjacent side panels in the present disclosure.

In this embodiment, the post 20 is disposed outside of an area surrounded by the two side panels 10 so that the post 20 is exposed. The side edges, which are adjacent to each other, of the two side panels 10 are each bent twice to define the first abutting edge 11 and the second abutting edge 12. The corners of the two sides of the notch 21 are right angles. The first positioning edge 22 is perpendicular to the second positioning edge 23, and the first abutting edge 11 is perpendicular to the second abutting edge 12. Referring to FIG. 4, the post 20 can be disposed within the area surrounded by the two side panels 10 so that the post 20 is hidden. At this time, the side edges, which are adjacent to each other, of the two side panels 10 are each bent once to define the first abutting edge 11 and a bending line 13. The side edges, which are adjacent to each other, of the two side panels 10 each comprise a portion 14 connected with the bending line 13 and defining the second abutting edge 12.

The post 20 has a hollow structure. The notch 21 comprises a closed surface 24 extending and connected between the first positioning edges 22, and the pressing strip 30 is connected to the closed surface 24. Specifically, the pressing strip 30 comprises a cover sheet 31 and a fastening piece 32 connected to a middle portion of a side surface of the cover sheet 31, and the fastening piece 32 is connected to the post 20. In a preferred embodiment, two sides of the cover sheet 31 bend toward the fastening piece 32 to define a first hook 33, and an edge of the first abutting edge 11 comprises a second hook 111 interlinking the first hook 33. The edge of the first abutting edge 11 and the pressing strip 30 respectively comprises the first hook 33 and the second hook 111, and the first hook 33 and the second hook 111 are connected to each other so as to further improve the stability of the connection.

Figure 3:
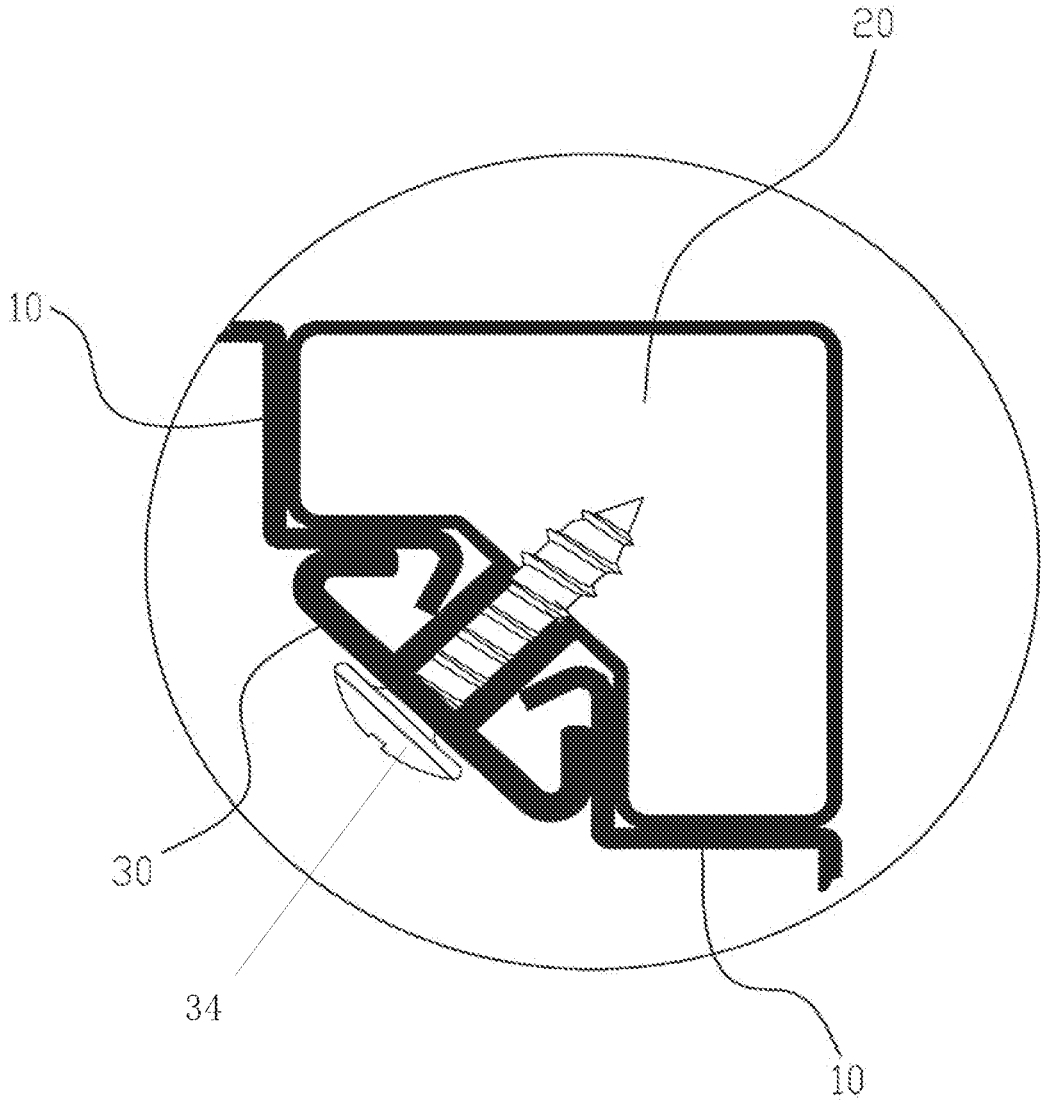
FIG. 3 illustrates a top view of a first type of splicing structure between adjacent side panels in the present disclosure.

A first end of the fastening piece 32 passes through the closed surface 24 and comprises a detachment-proof hook. In a preferred embodiment, as shown in FIG. 3, the pressing strip 30 can be connected to the post 20 by a screw 34.

Figure 5:
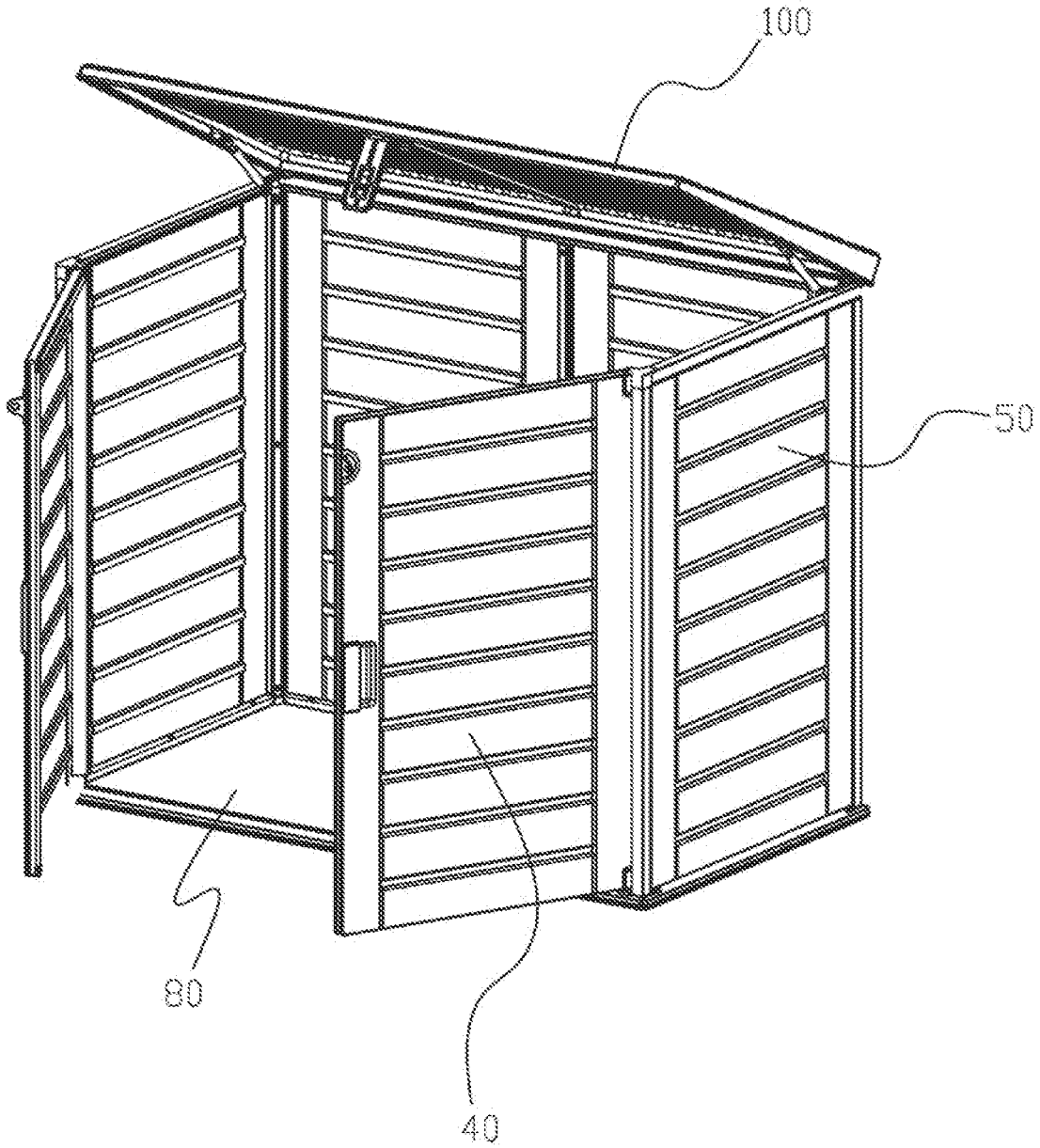
FIG. 5 illustrates a perspective view of a spliced storage box in a first embodiment of the present disclosure.
Figure 6:
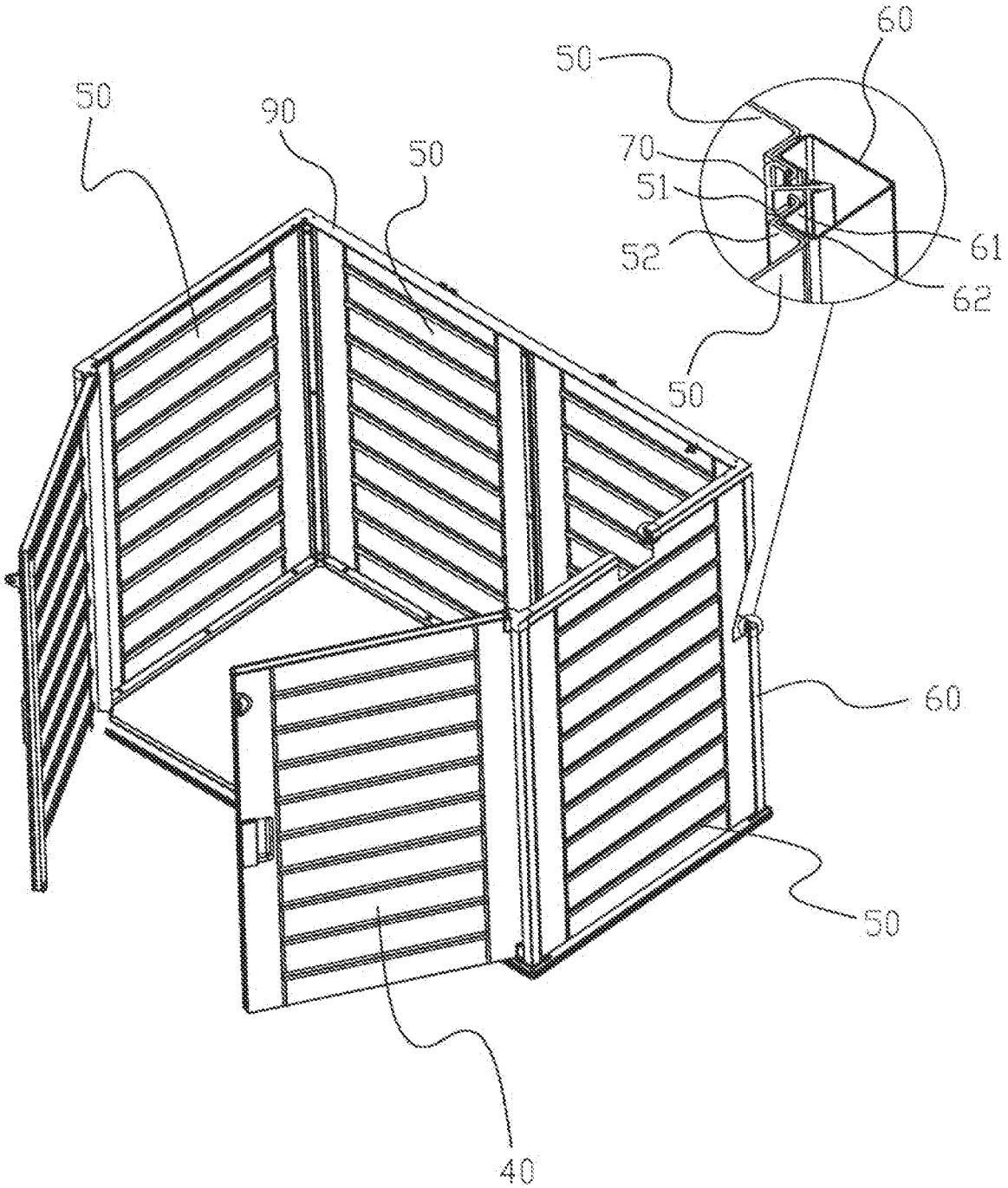
FIG. 6 illustrates a partial perspective view of the spliced storage box shown in FIG. 5.

Referring to FIG. 5 and FIG. 6, a spliced storage box of a first embodiment is provided. The spliced storage box comprises a plurality of side panels 50, which are connected through the above-mentioned splicing structure. The specific structure of the spliced storage box is described below. A front end surface of the spliced storage box comprises a pair of opening and closing doors 40. In some embodiments, the front end surface of the spliced storage box may have a single opening and closing door 40, and the disclosure is not limited to this regard. At least two of the plurality of side panels 50 disposed on a left side and a right side of the spliced storage box are respectively connected to at least one of the plurality of side panels 50 disposed on a rear side of the spliced storage box through a respective one of a plurality of posts 60. In this embodiment, a first of the plurality of side panels 50 disposed on the left side of the spliced storage box is connected to a third of the plurality of side panels 50 disposed on the rear side of the spliced storage box through a first of the plurality of posts 60, and a second of the plurality of side panels 50 disposed on the right side of the spliced storage box is connected to the third of the plurality of side panels 50 disposed on the rear side of the spliced storage through a second of the plurality of posts 60. A side of each of the plurality of posts 60 comprises a notch. Each corner of two sides of the notch comprises a first positioning edge 61 and a second positioning edge 62 intersecting the first positioning edge 61, and the first positioning edge 61 is disposed in the notch. Side edges, which are adjacent to each other, of two of the plurality of side panels 50 disposed on two sides of each of the plurality of posts 60 each bend and define a first abutting edge 51 and a second abutting edge 52, which correspond to a shape of each corner of the two sides of the notch. The first abutting edge 51 is disposed at an outer end of each of the two of the plurality of side panels 50. The first abutting edge 51 and the second abutting edge 52 of each of the two of the plurality of side panels 50 disposed on the two sides of each of the plurality of posts 60 respectively abut the first positioning edge 61 and the second positioning edge 62 disposed on each of the two sides of the notch. The spliced storage box further comprises a pressing strip 70 disposed vertically. The pressing strip 70 is disposed in the notch and is connected to each of the plurality of posts 60, and the pressing strip 70 is pressed on the first abutting edge 51 of the two of the plurality of side panels 50 disposed on the two sides of each of the plurality of posts 60. The connection between the two of the plurality of side panels 50 and each of the plurality of posts 60 is the same as the connection between the two side panels 10 and the post 20 shown in the above-mentioned splicing structure (i.e., the post 20 is disposed inside, as shown in FIG. 1-FIG. 3), and the pressing strip 70 is the same as the pressing strip 30.

Figure 7:
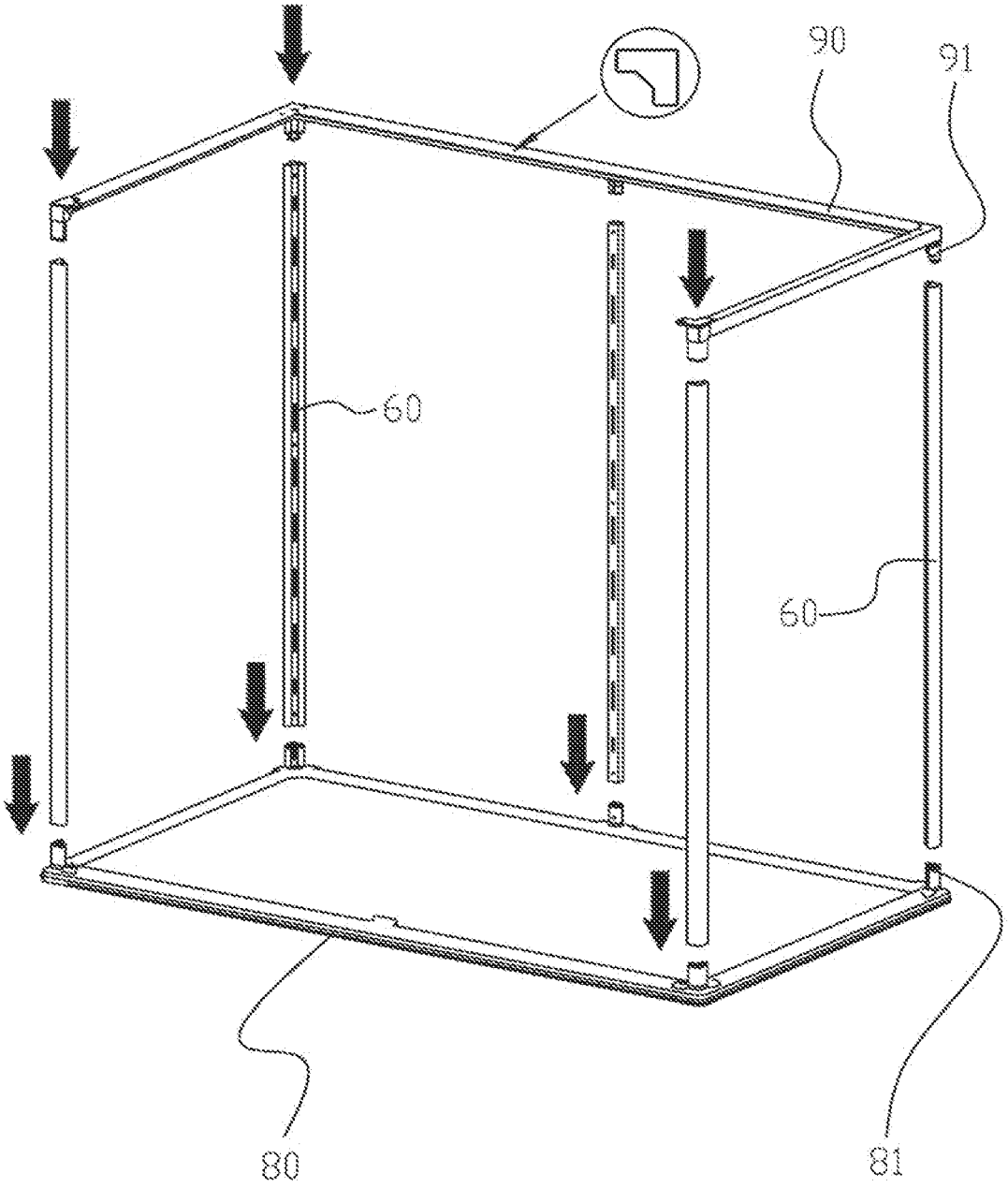
FIG. 7 illustrates a perspective view of a bottom panel, a plurality of posts, and an upper frame of the spliced storage box shown in FIG. 5.

Referring to FIG. 7, a bottom panel 80 of the spliced storage box comprises a positioning seat 81 disposed on a corner position thereof and corresponding to each of the plurality of posts 60, and a lower end of each of the plurality of posts 60 is connected to the positioning seat 81 through an insertion manner. The spliced storage box further comprises an upper frame 90 disposed and extending along upper edges of the plurality of side panels 50. The upper frame 90 comprises a plug 91, and an upper end of each of the plurality of posts 60 is connected to the plug 91 through an insertion manner. A rear side of an upper cover 100 of the spliced storage box is rotatably connected to the upper frame 90 so as to enable the upper cover 100 to be opened.

Figure 8:
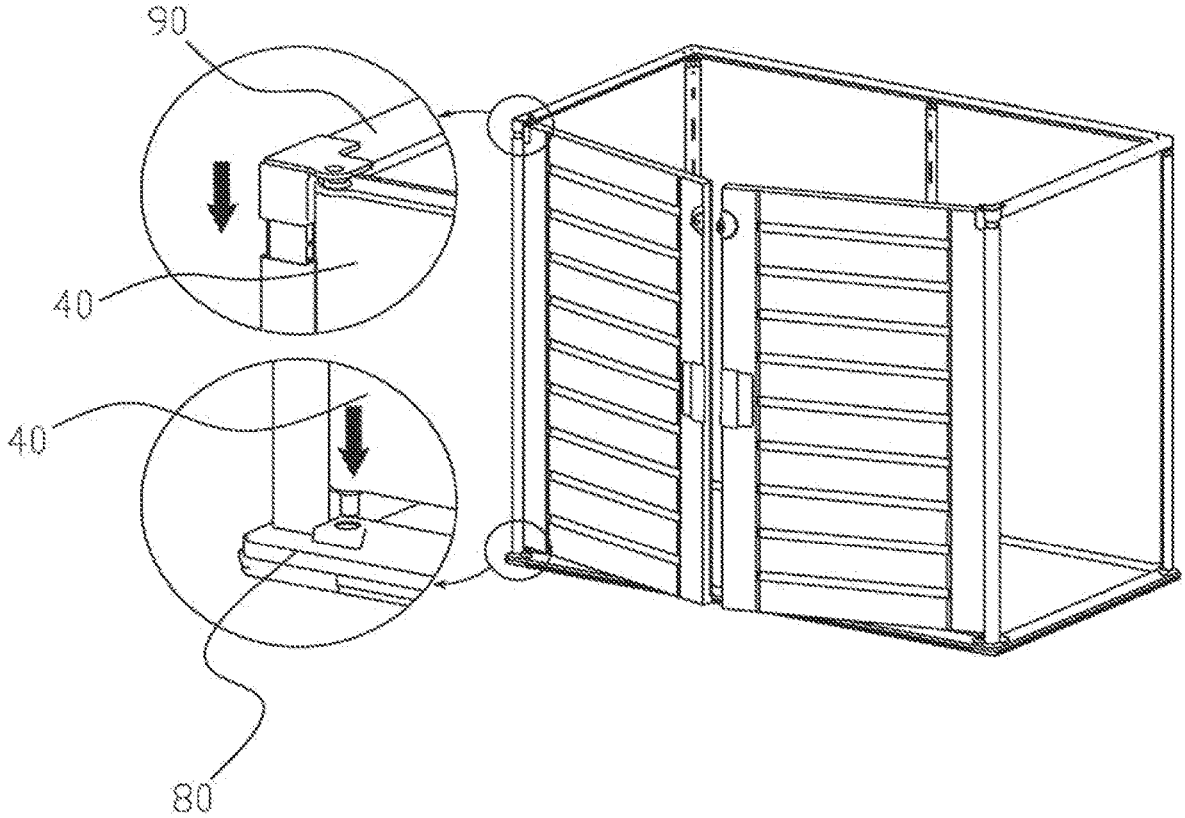
FIG. 8 illustrates a perspective view of a pair of opening and closing doors connected to the upper frame and the bottom panel of the spliced storage box shown in FIG. 5.

Referring to FIG. 8, an upper and lower ends of each of the pair of opening and closing doors 40 disposed on the front end surface of the spliced storage box are respectively rotatably connected to the upper frame 90 and the bottom panel 80.

Figure 9:
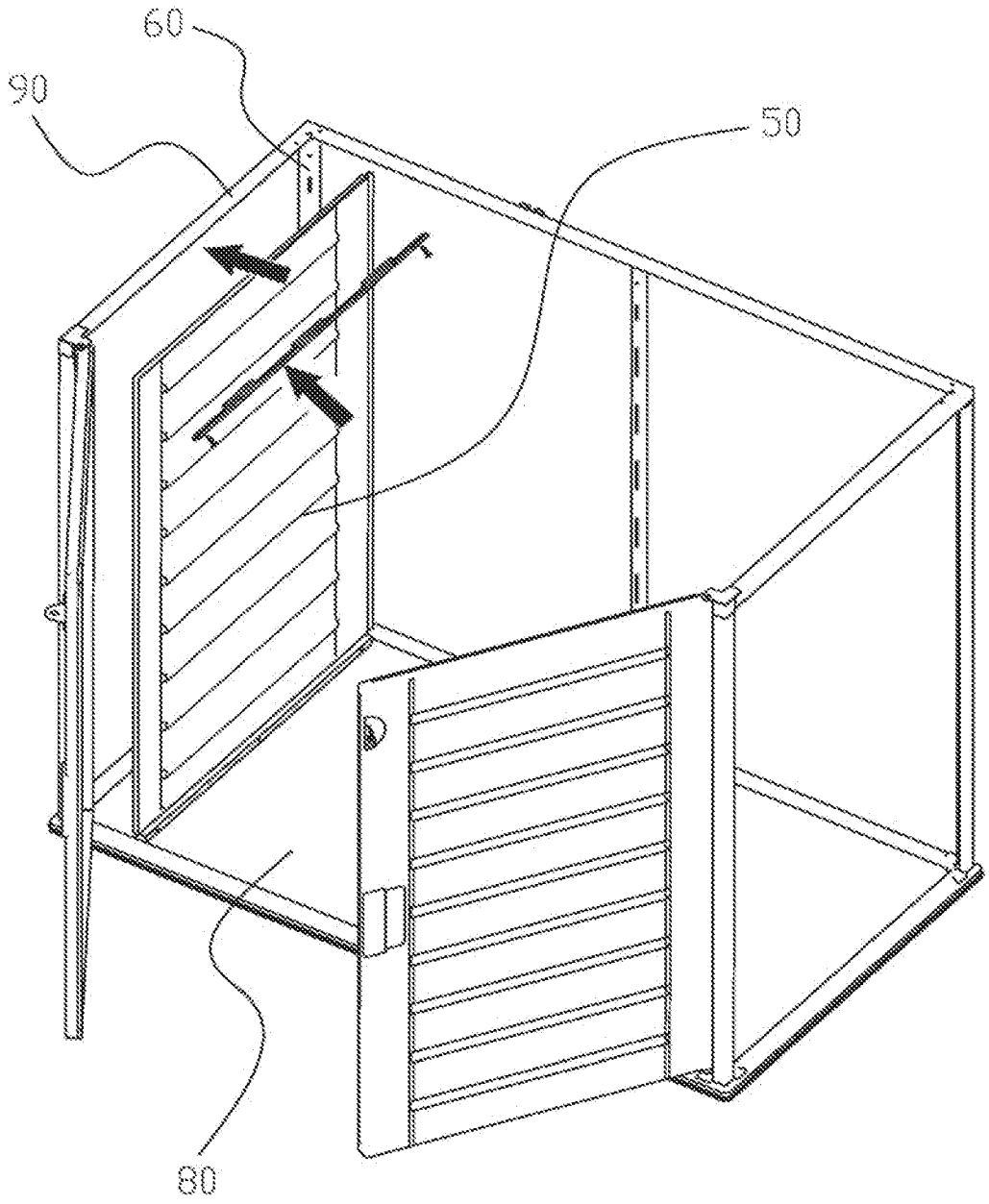
FIG. 9 illustrates a perspective view of a first of a plurality of side panels disposed on a left side of the spliced storage box shown in FIG. 5 when the first of the plurality of side panels is undergoing a splicing process.
Figure 10:
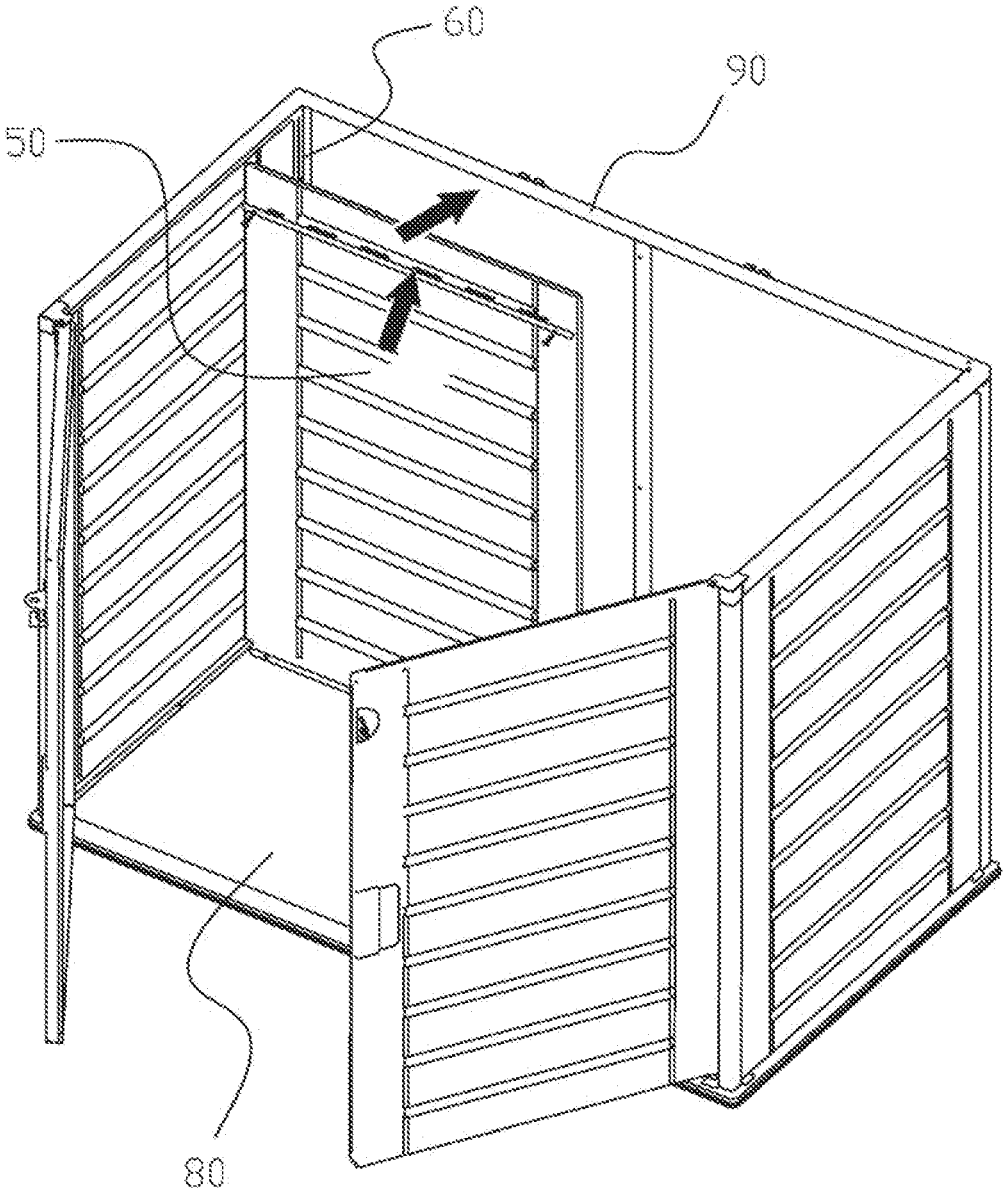
FIG. 10 illustrates a perspective view of a third of the plurality of side panels disposed on a rear side of the spliced storage box shown in FIG. 5 when the third of the plurality of side panels is undergoing the splicing process.

Combining FIG. 9 and FIG. 10, in this embodiment, the plurality of posts 60 are disposed outside of a box body (i.e., enclosed by the plurality of side panels 50, the upper cover, the bottom panel 80, and the pair of opening and closing doors). The side edge of each of the plurality of side panels 50 is bent twice to define the first abutting edge and the second abutting edge, and the plurality of side panels 50 are connected to the plurality of posts 60, the upper frame 90, and the bottom panel 80 along a direction from an inside of the box body to the outside of the box body.

Figure 11:
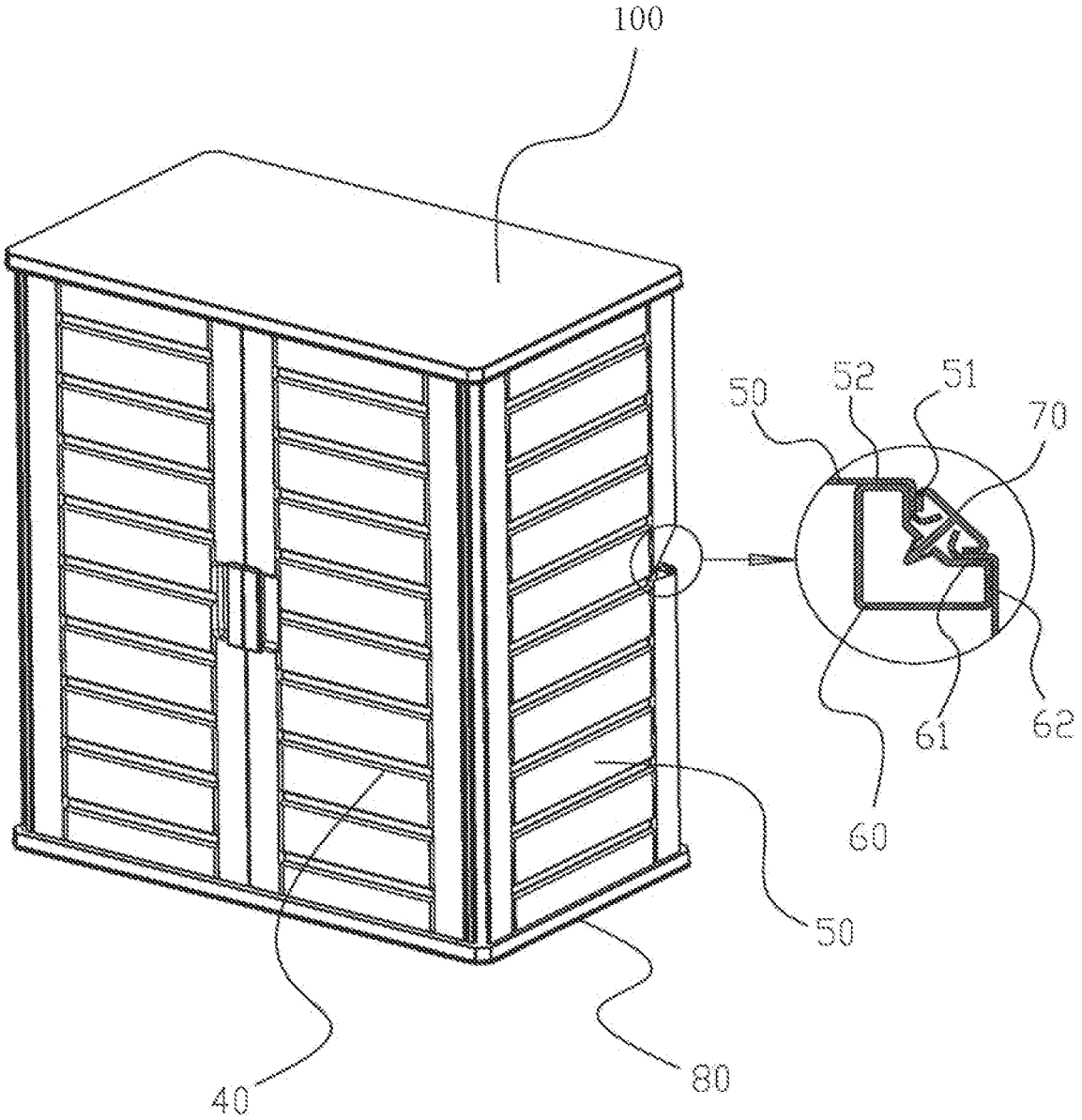
FIG. 11 illustrates a perspective view of a spliced storage box in a second embodiment of the present disclosure.
Figure 12:
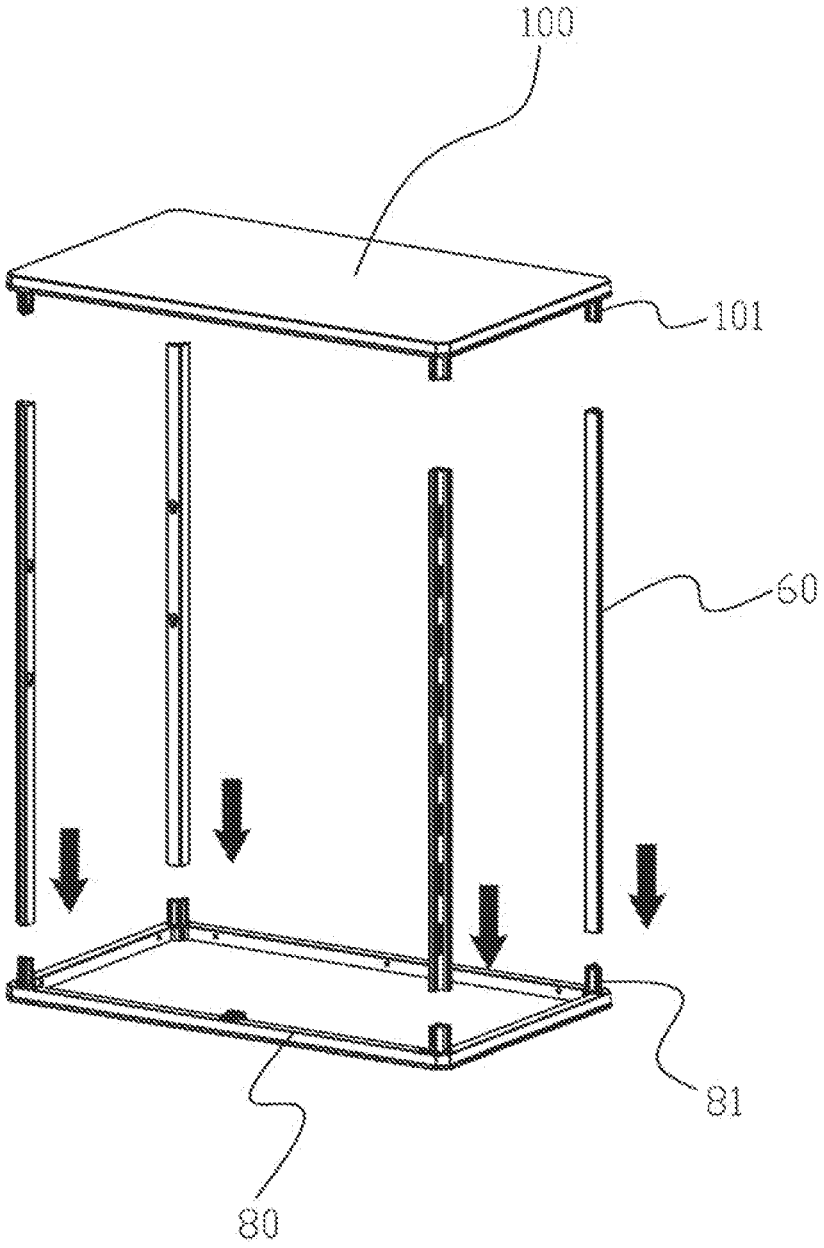
FIG. 12 illustrates a perspective view of a bottom panel, a plurality of posts, and an upper cover of the spliced storage box shown in FIG. 11.

Referring to FIG. 11 and FIG. 12, a spliced storage box of a second embodiment is provided. The difference between the spliced storage box of the second embodiment and the spliced storage box of the first embodiment is described below. Firstly, the upper cover 100 is a fixed structure, and the upper cover 100 does not need to rotate to be opened, so the upper frame can be omitted and a plug 101 is provided. The plug 101 is disposed on a corner position of the upper cover 100 and corresponds to each of the plurality of posts 60, and the upper end of each of the plurality of posts 60 is connected to the plug 101 through an insertion manner. Secondly, the upper end and the lower end of each of the pair of opening and closing doors 40 are respectively connected to the upper cover 100 and the bottom panel 80. Thirdly, the plurality of posts 60 are disposed inside of the box body. The side edges, which are adjacent to each other, of two of the plurality of side panels 50 disposed on two sides of each of the plurality of posts 60 are each bent once to define the first abutting edge 51 and a bending line. The side edges, which are adjacent to each other, of two of the plurality of side panels 50 disposed on two sides of each of the plurality of posts 60 each comprise a portion connected with the bending line and defining the second abutting edge 52. The plurality of side panels 50 are connected to the plurality of posts 60, the upper cover 100, and the bottom panel 80 along a direction from the outside of the box body to the inside of the box body. In this embodiment, the structure and the connection relationship of the plurality of posts 60 and the plurality of side panels 50 are the same as the splicing structure shown in FIG. 4.

Figure 13:
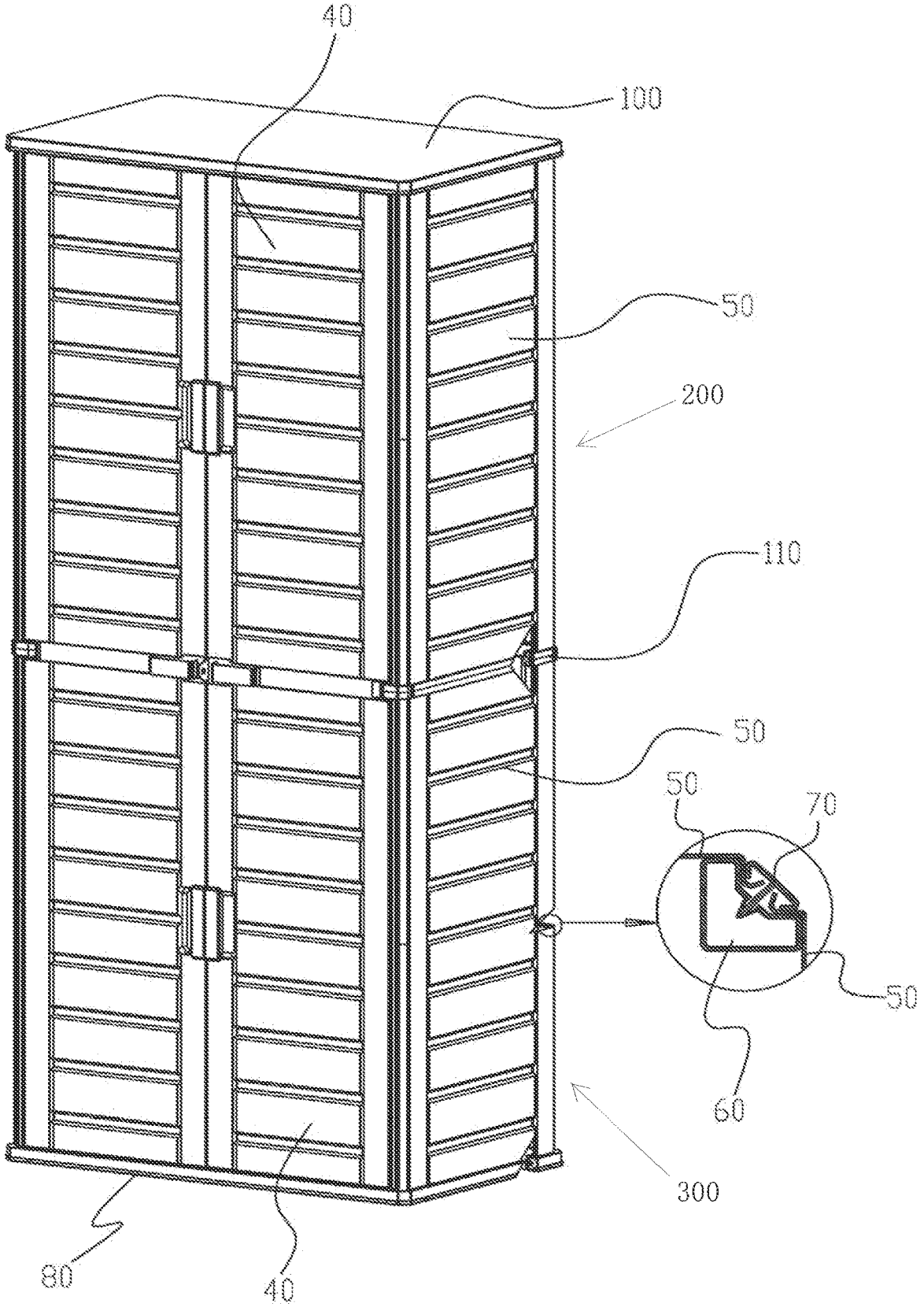
FIG. 13 illustrates a perspective view of a spliced storage box in a third embodiment of the present disclosure.
Figure 14:
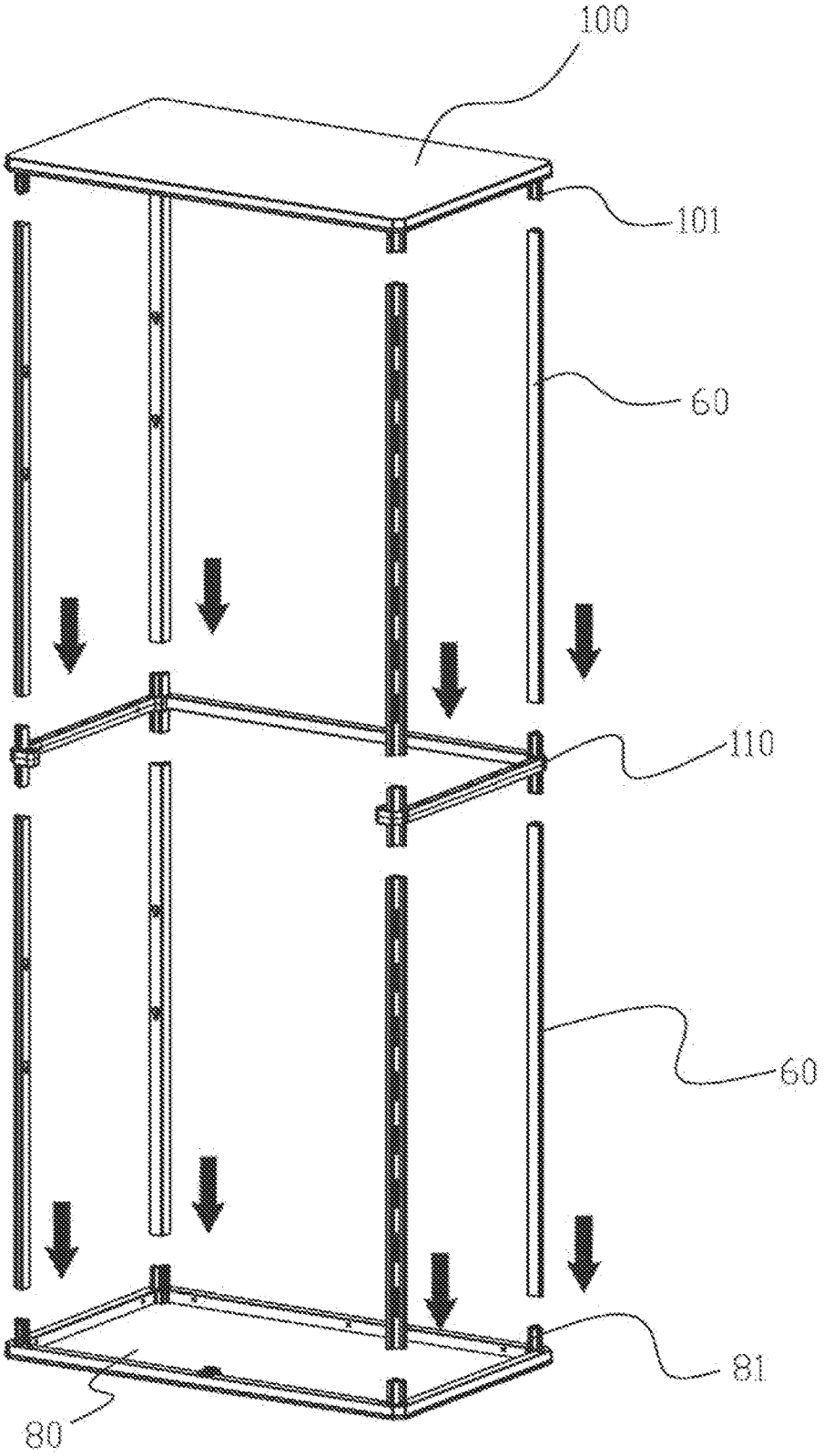
FIG. 14 illustrates a perspective view of a bottom panel, a plurality of posts, a connecting frame, and an upper cover of the spliced storage box shown in FIG. 13.

Referring to FIG. 13 and FIG. 14, a spliced storage box of a third embodiment is provided. The difference between the spliced storage box of the third embodiment and the spliced storage box of the second embodiment is described below. The spliced storage box is a two-layer structure. The spliced storage box comprises a connecting frame 110 disposed in a middle thereof. The spliced storage box comprises an upper layer box 200 and a lower layer box 300, which are separated along the connecting frame 110. At least two of the plurality of side panels 50 disposed on a left side and a right side of the upper layer box are respectively connected to at least one of the plurality of side panels 50 disposed on a rear side of the upper layer box through a respective one of a first set of the plurality of posts 60. At least two of the plurality of side panels 50 disposed on a left side and a right side of the lower layer box are respectively connected to at least one of the plurality of side panels 50 disposed on a rear side of the lower layer box through a respective one of a second set of the plurality of posts 60. An upper end and a lower end of each of the first set of the plurality of posts 60 disposed on the upper layer box are respectively connected to the upper cover 100 and the connecting frame 110 through an insertion manner, and an upper end and a lower end of each of the second set of the plurality of posts 60 disposed on the lower layer box are respectively connected to the connecting frame 110 and the bottom panel 80 through an insertion manner. The method of connecting the plurality of side panels 50 and the plurality of posts 60 is the same as the method described with respect to the spliced storage box shown in FIG. 11.

The connecting frame 110 is a U-shaped frame having an opening facing the front end surface of the spliced storage box. A first pair of opening and closing doors 40 disposed on the upper layer box is rotatably connected to the connecting frame 110 and the upper cover 100, and a second pair of opening and closing doors 40 disposed on the lower layer box is rotatably connected to the connecting frame 110 and the bottom panel 80.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A splicing structure between adjacent side panels of a spliced storage box, comprising:
- two side panels,
- a post, and
- a pressing strip, wherein:
  - the two side panels are adjacent to each other,
  - the post is disposed vertically,
  - a side of the post comprises a notch,
  - each corner of two sides of the notch comprises a first positioning edge and a second positioning edge intersecting the first positioning edge,
  - the first positioning edge is disposed in the notch,
  - side edges, which are adjacent to each other, of the two side panels each bend and define a first abutting edge and a second abutting edge, which correspond to a shape of each corner of the two sides of the notch,
  - the first abutting edge is disposed at an outer end of a respective one of the two side panels,
  - the first abutting edge and the second abutting edge respectively abut the first positioning edge and the second positioning edge,
  - the pressing strip is disposed vertically,
  - the pressing strip is disposed in the notch,
  - the pressing strip is connected to the post, and
  - the pressing strip is pressed to the first abutting edges of the two side panels.

2. The splicing structure between the adjacent side panels of the spliced storage box according to claim 1, wherein:
- the post is disposed within an area surrounded by the two side panels,
- the side edges, which are adjacent to each other, of the two side panels are each bent once to define the first abutting edge and a bending line, and
- the side edges, which are adjacent to each other, of the two side panels each comprise a portion connected with the bending line and defining the second abutting edge.

3. The splicing structure between the adjacent side panels of the spliced storage box according to claim 1, wherein:
- the post is disposed outside of an area surrounded by the two side panels, and
- the side edges, which are adjacent to each other, of the two side panels are each bent twice to define the first abutting edge and the second abutting edge.

4. The splicing structure between the adjacent side panels of the spliced storage box according to claim 1, wherein:
- the corners of the two sides of the notch are right angles,
- the first positioning edge is perpendicular to the second positioning edge, and
- the first abutting edge is perpendicular to the second abutting edge.

5. The splicing structure between the adjacent side panels of the spliced storage box according to claim 1, wherein:
- an edge of the first abutting edge and an edge of the pressing strip respectively comprises a first hook and a second hook, and
- the first hook and the second hook are connected to each other.

6. The splicing structure between the adjacent side panels of the spliced storage box according to claim 1, wherein:
- the post has a hollow structure,
- the notch comprises a closed surface extending and connected between the first positioning edges, and
- the pressing strip is connected to the closed surface.

7. The splicing structure between the adjacent side panels of the spliced storage box according to claim 6, wherein:
- the pressing strip comprises a fastening piece located inside of the pressing strip,
- a first end of the fastening piece comprises a detachment-proof hook, and
- the first end of the fastening piece passes through the closed surface.

8. The splicing structure between the adjacent side panels of the spliced storage box according to claim 6, wherein:
- the pressing strip is connected to the post by a screw.

9. The splicing structure between the adjacent side panels of the spliced storage box according to claim 1, wherein:
- the two side panels are blister boards,
- the post is a plastic hollow column, and
- the pressing strip is a plastic pressing strip.

10. The splicing structure between the adjacent side panels of the spliced storage box according to claim 1, wherein:

the pressing strip comprises a cover sheet and a fastening piece, the fastening piece is connected to a middle portion of a side surface of the cover sheet, the fastening piece is connected to the post, two sides of the cover sheet bend toward the fastening piece to define a first hook, and an edge of the first abutting edge comprises a second hook configured to interlink the first hook.

11. A spliced storage box, comprising:

an opening and closing door, a plurality of side panels, a plurality of posts, and a pressing strip, wherein:

the opening and closing door is disposed on a front end surface of the spliced storage box, at least two of the plurality of side panels disposed on a left side and a right side of the spliced storage box are respectively connected to at least one of the plurality of side panels disposed on a rear side of the spliced storage box through a respective one of the plurality of posts, a side of each of the plurality of posts comprises a notch, each corner of two sides of the notch comprises a first positioning edge and a second positioning edge intersecting the first positioning edge, the first positioning edge is disposed in the notch, side edges, which are adjacent to each other, of two of the plurality of side panels disposed on two sides of each of the plurality of posts each bend and define a first abutting edge and a second abutting edge, which correspond to a shape of each corner of the two sides of the notch, the first abutting edge is disposed at an outer end of each of the two of the plurality of side panels disposed on the two sides of each of the plurality of posts, the first abutting edge and the second abutting edge of each of the two of the plurality of side panels disposed on the two sides of each of the plurality of posts respectively abut the first positioning edge and the second positioning edge disposed on each of the two sides of the notch, the pressing strip is disposed vertically, the pressing strip is disposed in the notch, the pressing strip is connected to each of the plurality of posts, and the pressing strip is pressed on the first abutting edges of the two of the plurality of side panels disposed on the two sides of each of the plurality of posts.

12. The spliced storage box according to claim 11, wherein:

the spliced storage box comprises a bottom panel, an upper cover, and an upper frame, the bottom panel comprises a positioning seat disposed on a corner position of the bottom panel and corresponding to each of the plurality of posts, a lower end of each of the plurality of posts is connected to the positioning seat through an insertion manner, the upper frame is disposed and extends along upper edges of the plurality of side panels, the upper frame comprises a plug corresponding to each of the plurality of posts, an upper end of each of the plurality of posts is connected to the plug through an insertion manner, and a rear side of the upper cover is rotatably connected to the upper frame.

13. The spliced storage box according to claim 12, wherein:

an upper end and a lower end of the opening and closing door disposed on the front end surface of the spliced storage box are respectively rotatably connected to the upper frame and the bottom panel.

14. The spliced storage box according to claim 12, wherein:

the plurality of posts are disposed outside of a box body, the side edges, which are adjacent to each other, of the two of the plurality of side panels disposed on the two sides of each of the plurality of posts are each bent twice to define the first abutting edge and the second abutting edge, and the plurality of side panels are connected to the plurality of posts, the upper frame, and the bottom panel along a direction from an inside of the box body to the outside of the box body.

15. The spliced storage box according to claim 11, wherein:

the spliced storage box comprises a bottom panel and an upper cover, the bottom panel comprises a positioning seat disposed on a corner position of the bottom panel and corresponding to each of the plurality of posts, a lower end of each of the plurality of posts is connected to the positioning seat through an insertion manner, the upper cover comprises a plug disposed on a corner position of the upper cover and corresponding to each of the plurality of posts, and an upper end of each of the plurality of posts is connected to the plug through an insertion manner.

16. The spliced storage box according to claim 15, wherein:

an upper end and a lower end of the opening and closing door disposed on the front end surface of the spliced storage box are respectively rotatably connected to the upper cover and the bottom panel.

17. The spliced storage box according to claim 15, wherein:

the plurality of posts are disposed inside of a box body, the side edges, which are adjacent to each other, of the two of the plurality of side panels disposed on the two sides of each of the plurality of posts are each bent once to define the first abutting edge and a bending line, the side edges, which are adjacent to each other, of the two of the plurality of side panels disposed on the two sides of each of the plurality of posts each comprise a portion connected with the bending line and defining the second abutting edge, and the plurality of side panels are connected to the plurality of posts along a direction from an outside of the box body to the inside of the box body.

18. A spliced storage box, comprising:

an upper cover, a bottom panel, a connecting frame, a plurality of side panels, a plurality of posts, and a pressing strip, wherein:

the connecting frame is disposed in a middle of the spliced storage box so that the spliced storage box is divided into an upper layer box and a lower layer box along the connecting frame, at least two of the plurality of side panels disposed on a left side and a right side of the upper layer box are respectively connected to at least one of the plurality of side panels disposed on a rear side of the upper layer box through a respective one of a first set of the plurality of posts, an upper end and a lower end of each of the first set of the plurality of posts disposed on the upper layer box are respectively connected to the upper cover and the connecting frame through an insertion manner, at least two of the plurality of side panels disposed on a left side and a right side of the lower layer box are respectively connected to at least one of the plurality of side panels disposed on a rear side of the lower layer box through a respective one of a second set of the plurality of posts, an upper end and a lower end of each of the second set of the plurality of posts disposed on the lower layer box are respectively connected to the connecting frame and the bottom panel through an insertion manner, a side of each of the plurality of posts comprises a notch, each corner of two sides of the notch comprises a first positioning edge and a second positioning edge intersecting the first positioning edge, the first positioning edge is disposed in the notch, side edges, which are adjacent to each other, of two of the plurality of side panels disposed on two sides of each of the plurality of posts each bend and define a first abutting edge and a second abutting edge, which correspond to a shape of each corner of the two sides of the notch, the first abutting edge is disposed at an outer end of each of the two of the plurality of side panels disposed on the two sides of each of the plurality of posts, the first abutting edge and the second abutting edge of each of the two of the plurality of side panels disposed on the two sides of each of the plurality of posts respectively abut the first positioning edge and the second positioning edge disposed on each of the two sides of the notch, the pressing strip is disposed vertically, the pressing strip is disposed in the notch, the pressing strip is connected to each of the plurality of posts, and the pressing strip is pressed on the first abutting edges of the two of the plurality of side panels disposed on the two sides of each of the plurality of posts.

19. The spliced storage box according to claim 18, wherein:

the plurality of posts are disposed inside of a box body, the side edges, which are adjacent to each other, of the two of the plurality of side panels disposed on the two sides of each of the plurality of posts are each bent once to define the first abutting edge and a bending line, the side edges, which are adjacent to each other, of the two of the plurality of side panels disposed on the two sides of each of the plurality of posts each comprise a portion connected with the bending line and defining the second abutting edge, and the plurality of side panels are connected to the plurality of posts along a direction from an outside of the box body to the inside of the box body.

20. The spliced storage box according to claim 19, wherein:

the connecting frame is a U-shaped frame having an opening facing a front end surface of the spliced storage box, a first opening and closing door disposed on a front end surface of the upper layer box is rotatably connected to the connecting frame and the upper cover, and a second opening and closing door disposed on a front end surface of the lower layer box is rotatably connected to the connecting frame and the bottom panel.

21. A corner board comprising:

two side panels, a post, and a pressing strip, wherein:

the post connects the two side panels, a side of the post comprises a notch, each of two sides of the notch comprises a first positioning edge and a second positioning edge intersecting the first positioning edge, the first positioning edge is disposed in the notch, side edges, which are adjacent to each other, of the two side panels each bend and define a first abutting edge and a second abutting edge, which correspond to a shape of each corner of the two sides of the notch, the first abutting edge is disposed at an outer end of a respective one of the two side panels, the first abutting edge and the second abutting edge respectively abut the first positioning edge and the second positioning edge, the pressing strip is disposed vertically, the pressing strip is disposed in the notch, the pressing strip is connected to the post, and the pressing strip is pressed to the first abutting edges of the two side panels.

22. The corner board according to claim 21, wherein:

the post is hollow or partially hollow.

23. The corner board according to claim 21, wherein:

the post is disposed within an area surrounded by the two side panels, the side edges, which are adjacent to each other, of the two side panels are each bent once to define the first abutting edge and a bending line, and the side edges, which are adjacent to each other, of the two side panels each comprise a portion connected with the bending line and defining the second abutting edge.

24. The corner board according to claim 21, wherein:

the post is disposed outside of an area surrounded by the two side panels, and the side edges, which are adjacent to each other, of the two side panels are each bent twice to define the first abutting edge and the second abutting edge.

25. The corner board according to claim 21, wherein:

the corners of the two sides of the notch are right angles, the first positioning edge is perpendicular to the second positioning edge, and the first abutting edge is perpendicular to the second abutting edge.

26. The corner board according to claim 21, wherein:

an edge of the first abutting edge and an edge of the pressing strip respectively comprises a first hook and a second hook, and the first hook and the second hook are connected to each other.

* * * * *